US012529214B2

(12) United States Patent
Liu et al.

(10) Patent No.: US 12,529,214 B2
(45) Date of Patent: Jan. 20, 2026

(54) HOLDER DEVICE FOR SHOWER APPARATUS

(71) Applicant: XIAMEN RAINSHOWER CO., LTD., Xiamen (CN)

(72) Inventors: Hewei Liu, Xiamen (CN); Weifeng Zeng, Xiamen (CN); Ruiqiang Zhang, Xiamen (CN)

(73) Assignee: XIAMEN RAINSHOWER CO., LTD., Xiamen (CN)

( * ) Notice: Subject to any disclaimer, the term of this patent is extended or adjusted under 35 U.S.C. 154(b) by 112 days.

(21) Appl. No.: 18/631,079

(22) Filed: Apr. 10, 2024

(65) Prior Publication Data

US 2024/0337094 A1 Oct. 10, 2024

(30) Foreign Application Priority Data

Apr. 10, 2023 (CN) ..... 202310375642.9

(51) Int. Cl.
*E03C 1/06* (2006.01)
*E03C 1/04* (2006.01)

(52) U.S. Cl.
CPC ..... *E03C 1/0408* (2013.01); *E03C 1/06* (2013.01); *E03C 2201/30* (2013.01); *E03C 2201/40* (2013.01)

(58) Field of Classification Search
CPC ..... E03C 1/0408; E03C 1/06; E03C 2201/30; E03C 2201/40
USPC ..... 4/596
See application file for complete search history.

(56) References Cited

U.S. PATENT DOCUMENTS

| | | | | |
|---|---|---|---|---|
| 8,268,168 | B2 | 9/2012 | Mang | |
| 11,090,670 | B2 * | 8/2021 | Fan | B05B 12/0024 |
| 12,152,681 | B2 * | 11/2024 | Yu | E03C 1/023 |
| 2009/0266913 | A1 * | 10/2009 | Tsai | E03C 1/06 239/283 |
| 2020/0291626 | A1 * | 9/2020 | Wu | B05B 1/1681 |
| 2021/0023579 | A1 * | 1/2021 | Yu | B05B 15/62 |

* cited by examiner

*Primary Examiner* — Huyen D Le

(57) ABSTRACT

A holder device for a shower apparatus includes a seat body, a waterway switching device, a filter element and an attaching seat. One end of the seat body forms a closed end, and a waterway switching device is disposed at another end of the seat body. An outer wall of the seat body is provided with a water inlet port, a first water outlet port and a second water outlet port. The first water outlet port is arranged on a side adjacent to the closed end, the first water outlet port is configured to be connected to an overhead shower, and the second water outlet port is configured to be connected to a handheld water outlet device. controlling water to flow out from the first water outlet port and/or the second water outlet port. The water flow is controlled by the waterway switching device to be in communication with the first water outlet port or/and the second water outlet port. The attaching seat is sleeved on the seat body and is adjacently connected to the actuator, to allow the attaching seat and the actuator to be jointly arranged offset with respect to the first water outlet port in the axial direction of the seat body. The attaching seat is configured to hang the handheld water outlet device. With such an arrangement, the attaching seat and the knob are not blocked by the overhead shower, thereby facilitating the picking and placing of the handheld water outlet device and waterway switching.

13 Claims, 13 Drawing Sheets prior art

HOLDER DEVICE FOR SHOWER APPARATUS

CROSS REFERENCE TO RELATED APPLICATIONS

This application is based upon and claims priority to Chinese Patent Application No. 202310375642.9, filed on Apr. 10, 2023, the entire contents of which are incorporated herein by reference.

FIELD

This application relates to the field of sanitary ware, and in particular to a holder device for a shower apparatus.

BACKGROUND

A holder device for a dual shower has been disclosed on the market. For details, reference may be made to the Patent document U.S. Pat. No. 7,299,510. Referring to FIG. 1, the holder device includes a seat body 10*a*, the seat body 10*a* extends in an axial direction to form a tubular body, and the seat body 10*a* is provided in its outer wall with a water inlet tube 11*a*, a first water outlet tube 16*a* and a second water outlet tube 17*a*. Specifically, the first water outlet tube 16*a* is arranged substantially in the middle of the seat body 10*a*, the water inlet tube 11*a* is assembled to a wall-mounted water outlet tube, the first water outlet tube 16*a* is connected to an overhead shower, and the second water outlet tube 17*a* is connected to a water outlet tube of a handheld showerhead. An attaching seat 24*a* and a knob 50*a* are provided at both axial ends of the seat body 10*a* respectively. The attaching seat 24*a* is used to place the handheld showerhead, the knob 50*a* is arranged to move along with a switching valve in an inner cavity of the seat body 10*a*. By rotating the knob 50*a*, the switching valve controls the water flow to communicate with the first water outlet tube 16*a* or/and the second water outlet tube 17*a*. However, if the diameter of the overhead shower is more than 6 inches, the attaching seat 24*a* and the knob 50*a* will be blocked by the overhead shower, so that the user needs to bypass the overhead shower to hang the handheld shower and rotate the knob 50*a*, which is really inconvenient.

In view of this, the present application has made an in-depth study on the above-described deficiencies in the prior art, and thus, the present application is developed.

SUMMARY

An aspect according to the present application is to provide a holder device for a shower apparatus, in which, a first water outlet port is arranged to be offset with respect to an attaching seat so that the attaching seat and a knob are not blocked by an overhead shower, thereby facilitating the picking and placing of the handheld water outlet device and waterway switching, and moreover, by additionally providing a filter element, water filtration is achieved and the quality of life is improved.

In order to achieve the above aspect, a holder device for a shower apparatus is provided according to the present application, which includes a seat body, a waterway switching device, a filter element and an attaching seat. The seat body is configured to extend in an axial direction thereof, one end of the seat body forms a closed end, and a waterway switching device is disposed at another end of the seat body. An outer wall of the seat body is provided with a water inlet port, a first water outlet port and a second water outlet port. The first water outlet port is arranged on a side adjacent to the closed end, the water inlet port is configured to be connected to a water outlet tube, the first water outlet port is configured to be connected to an overhead shower, and the second water outlet port is configured to be connected to a water outlet hose of a handheld water outlet device. An inner cavity of the seat body is provided with a water inlet passage, a first water outlet passage and a second water outlet passage arranged in parallel with each other at intervals in the axial direction of the seat body. A water diverting piece is provided in the inner cavity of the seat body at a side adjacent to the waterway switching device of the water inlet passage, the first water outlet passage and the second water outlet passage. The water diverting piece is provided with a water outlet, a first water inlet and a second water inlet, and by the water diverting piece, the inner cavity of the seat body is constructed as a valve chamber at the end on the side where the water diverting piece is located. One end of the water inlet passage is in fluid connection with the water inlet port, and another end of the water inlet passage is in fluid connection with the water outlet of the water diverting piece; one end of the first water outlet passage is in fluid connection with the first water outlet port, and another end of the first water outlet passage is in fluid connection with the first water inlet of the water diverting piece; and one end of the second water outlet passage is in fluid connection with the second water outlet port, and another end of the second water outlet passage is in fluid connection with the second water inlet of the water diverting piece.

The filter element includes a body and a filter material built into the body. The body is provided with an inlet end and an outlet end. The filter element is placed in the water inlet passage. The water flowing in through the water inlet port passes through sequentially the inlet end and the outlet end of the filter element, and the water outlet of the water diverting piece and flows into the valve chamber.

The waterway switching device includes an actuator and a water diverting valve core. The actuator is arranged at an end of the seat body, the water diverting valve core is arranged in the valve chamber, and is at least provided with a plug facing towards the water diverting piece. An external force acts on the actuator to drive the plug of the water diverting valve core to be displaced, to allow the plug in the valve seat to selectively block the first water inlet or the second water inlet of the water diverting piece, or block both part of the first water inlet and part of the second water inlet in the water diverting piece simultaneously, thereby controlling water to flow out from the first water outlet port and/or the second water outlet port.

The attaching seat is sleeved on the seat body and is adjacently connected to the actuator, to allow the attaching seat and the actuator to be jointly arranged offset with respect to the first water outlet port in the axial direction of the seat body. The attaching seat is provided with a socket, and the socket is configured to hang the handheld water outlet device.

BRIEF DESCRIPTION OF THE DRAWINGS

A specific description is given as a non-limiting example to better explain what the present application consists of and how it may be implemented, and furthermore this description is made in conjunction with the drawings, in which.

DETAILED DESCRIPTION OF EMBODIMENTS

Figure 1:
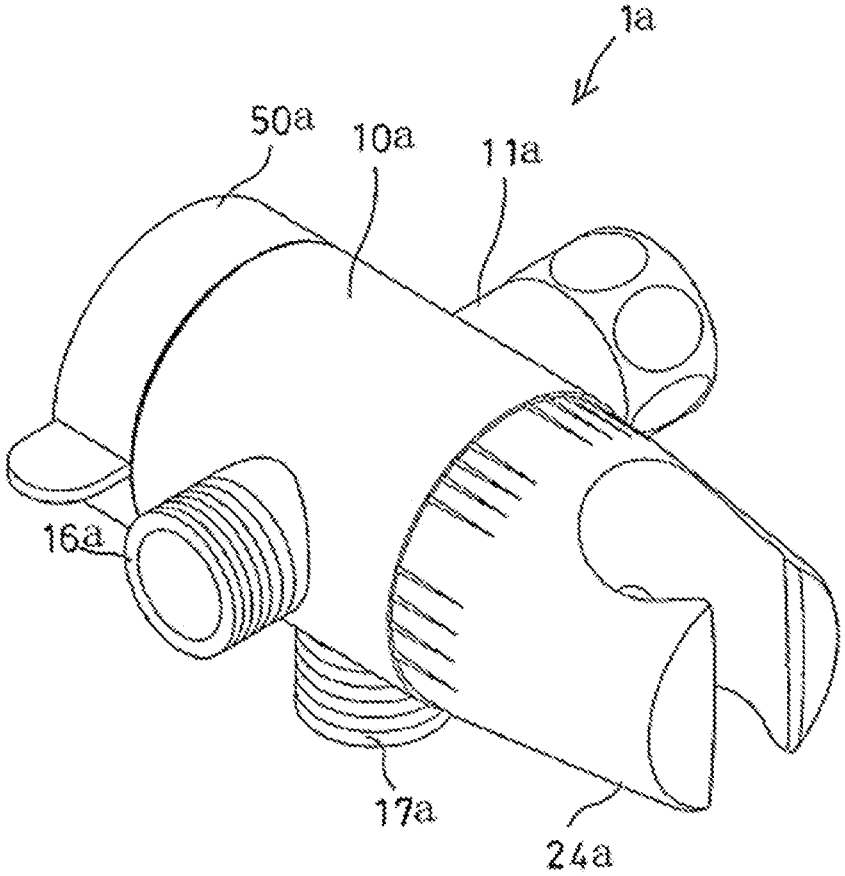
FIG. 1 is a structural diagram of a three-way shower holder in the prior art.

The present application is described in detail hereinafter in combination with the drawings and embodiments.

In the description of the present application, it is to be appreciated that the orientation or positional relationship indicated by the terms "axial", "circumferential", etc. are based on the orientation or positional relationship shown in the drawings, and are only for the convenience of describing the present application and simplifying the description.

Figure 5:
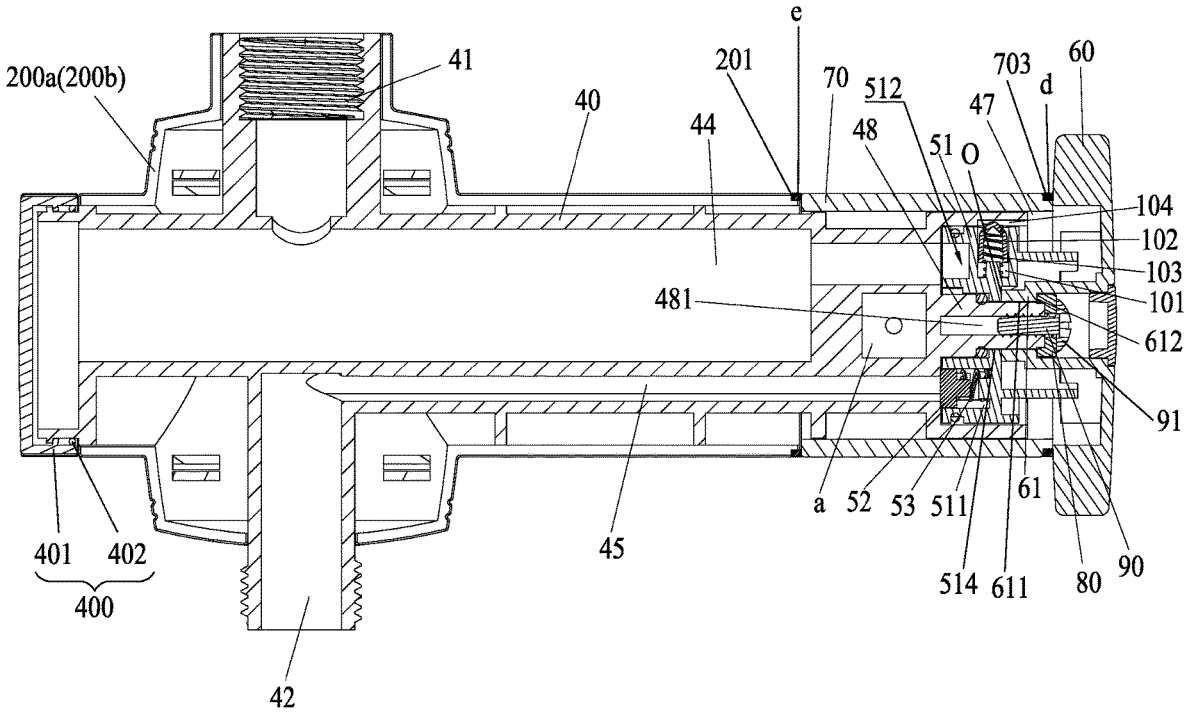
FIG. 5 is a longitudinal cross-sectional view of the holder device according to the present application.
Figure 6:
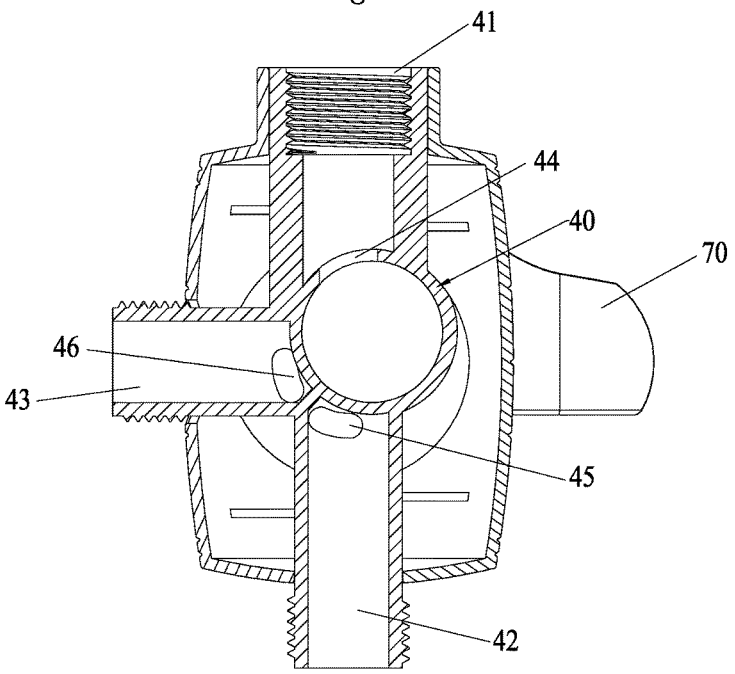
FIG. 6 is a transverse cross-sectional view of the holder device according to the present application.
Figure 7:
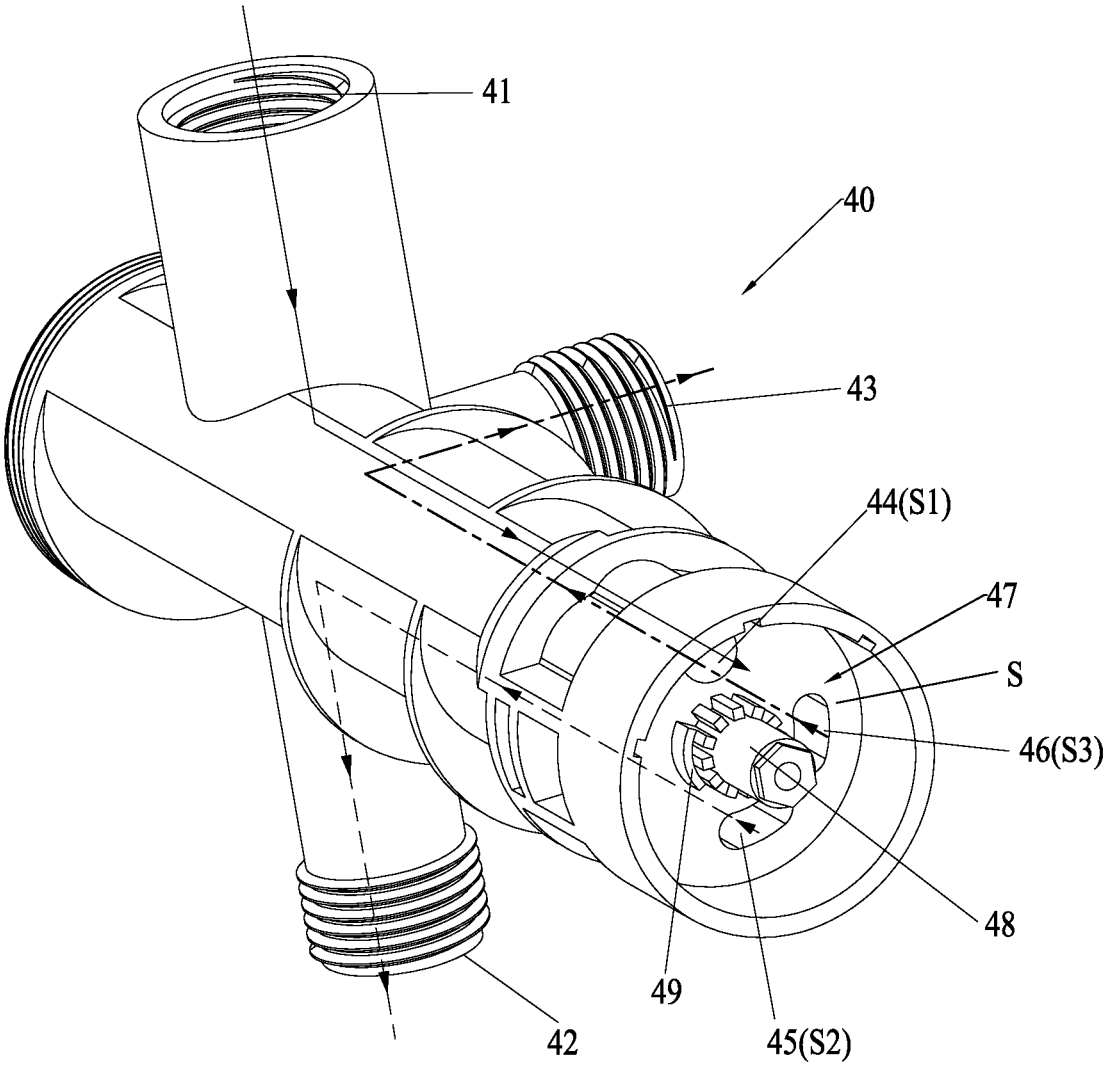
FIG. 7 is a structural diagram of a seat body according to the present application.

Please refer to FIGS. 2 to 7, FIG. 9, FIG. 10 and FIG. 14. A holder device for a shower apparatus is disclosed according to the present application, which includes a seat body 40, a waterway switching device 5 and an attaching seat 70. The seat body 40 is configured to extend in its axial direction, and one end of the seat body 40 forms a closed end 400. For example, the closed end 400 of the seat body 40 is formed by fixedly connecting a partition (not shown) to the end of the seat body 40, or the closed end 400 of the seat body 40 is formed by a detachable cover 401 and a scaling member 402 (as shown in FIG. 5). A waterway switching device 5 is disposed at another end of the seat body 40. An outer wall of the seat body 40 is provided with a water inlet port 41, a first water outlet port 42 and at least one second water outlet port 43. In this embodiment, only one second water outlet port 43 is provided in the seat body 40. The first water outlet port 42 is arranged on a side adjacent to the closed end 400. The water inlet port 41 is configured to be connected to a wall-mounted water outlet tube 500. The first water outlet port 42 is configured to be connected to an overhead shower 600. The second water outlet port 43 is configured to be connected to a water outlet hose of a handheld water outlet device 700. In a more preferred design, the water inlet port 41 is arranged opposite to the first water outlet port 42, and a central axis Z of the water inlet port 41, a central axis X of the first water outlet port 42 and a central axis M of the second water outlet port 43 are located in the same plane P. With such a design, the appearance of the holder device may be more aesthetic, and force is received more uniformly.

An inner cavity of the seat body 40 is provided with a water inlet passage 44, a first water outlet passage 45 and a second water outlet passage 46. A water diverting piece (S) is additionally provided in the inner cavity of the seat body 40 at a position adjacent to the waterway switching device 5. By the water diverting piece (S), the inner cavity of the seat body 40 is constructed as a valve chamber 47 at this end on this side where the water diverting piece (S) is located. The water passage directions designed for the water inlet passage 44, the first water outlet passage 45 and the second water outlet passage 46 are preferably arranged in parallel with each other at intervals in the axial direction of the seat body 40. A water outlet (S1), a first water inlet (S2) and a second water inlet (S3) are circumferentially distributed in the water diverting piece (S). One end of the water inlet passage 44 is in fluid connection with the water inlet port 41, and another end of the water inlet passage 44 is in fluid connection with the water outlet (S1); one end of the first water outlet passage 45 is in fluid connection with the first water outlet port 42, and another end of the first water outlet passage 45 is in fluid connection with the first water inlet (S2); and one end of the second water outlet passage 46 is in fluid connection with the second water outlet port 43, and another end of the second water outlet passage 46 is in fluid connection with the second water inlet (S3), so that the water inlet passage 44, the first water outlet passage 45 and the second water outlet passage 46 are respectively in fluid connection with the valve chamber 47.

Figure 8:
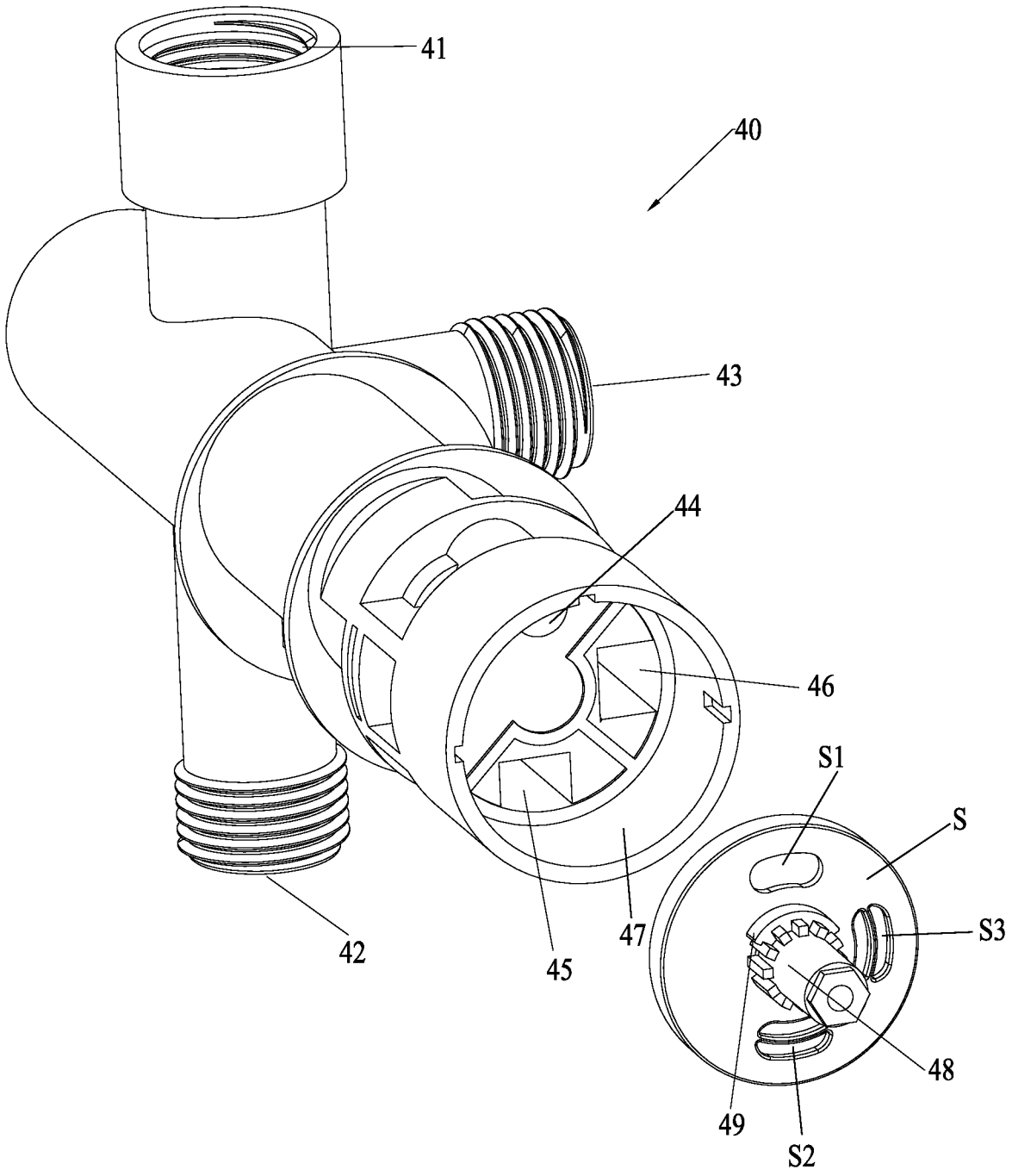
FIG. 8 is a structural diagram of another embodiment of the seat body according to the present application.
Figure 9:
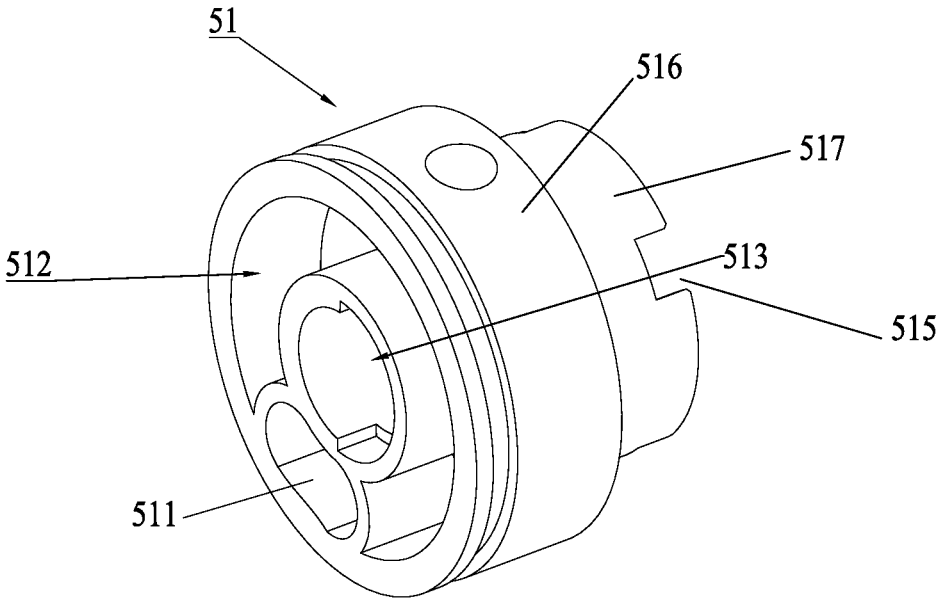
FIG. 9 is a structural diagram of a valve seat according to the present application.
Figure 10:
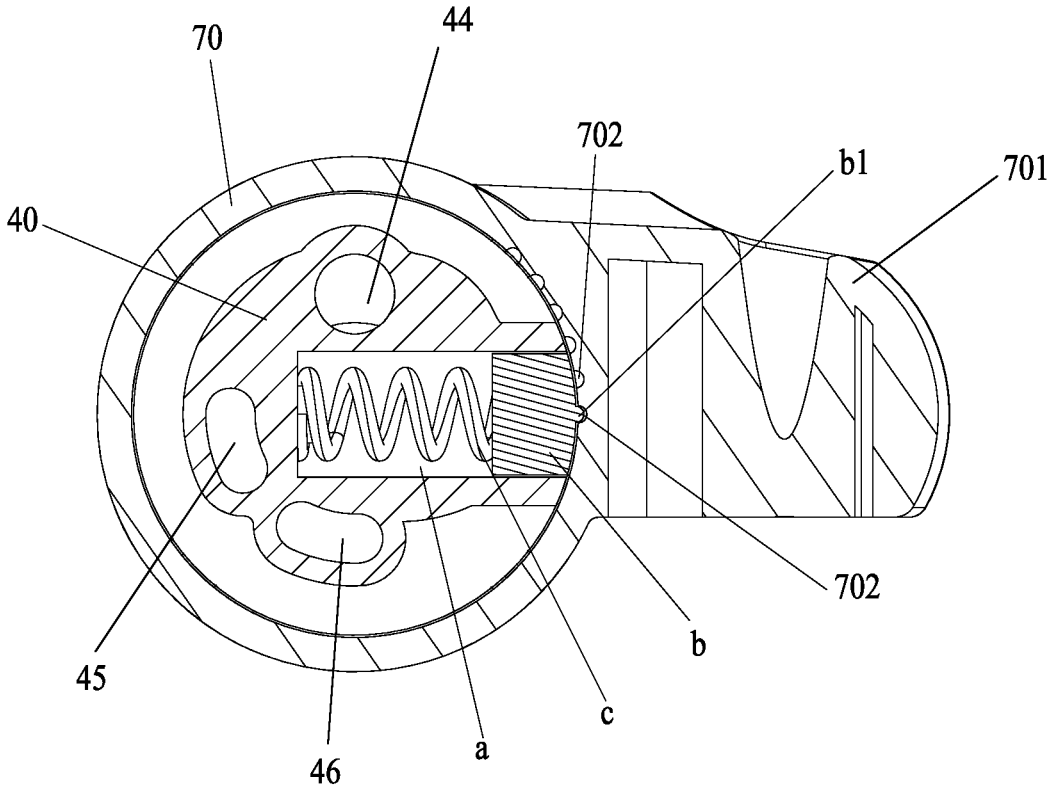
FIG. 10 is a cross-sectional view showing the attaching seat fitted with the seat body according to the present application.

The waterway switching device 5 includes an actuator 60 and a water diverting valve core 50. The actuator 60 is a knob. The knob 60 is arranged at an end of the seat body 40. The water diverting valve core 50 is arranged in the valve chamber 47, and the valve chamber 47 is a circular chamber. The water diverting valve core 50 includes a valve seat 51, a plug 52 and a first spring 53. The valve seat 51 is in a cylindrical shape. In a preferred design, the valve seat 51 has an outer cylinder wall 516 and an inner cylinder wall 517 which are concentrically arranged, and an axial length L1 of the outer cylinder wall 516 is smaller than an axial length L2 of the inner cylinder wall 517. This design aims at saving material on the premise of ensuring the strength of the valve seat 51. A first positioning post 48 is provided to protrude from the center of the water diverting piece (S). The first positioning post 48 is provided therein with a threaded hole 481. The valve seat 51 is provided with a first positioning through hole 514 at a central axial part thereof. An inner wall of the knob 60 is provided with a second positioning post 61 at a central axial part thereof. The second positioning post 61 is provided with an axially penetrating second positioning through hole 611. The second positioning through hole 611 is provided therein with a retaining edge 612. The first positioning through hole 514 of the valve seat 51 and the second positioning post 61 of the knob 60 are sleeved on the first positioning post 48 in sequence from the inside to the outside, to allow an end of the second positioning post 61 to abut against an outer edge end (O) of the first positioning through hole 514 so that the valve seat 51 will not deviate outward in its axial direction. At least one scaling ring (f) is additionally provided between an outer wall of the first positioning post 48 and an inner wall of the first positioning through hole 514 of the valve seat 51, and at least one sealing ring (f) is additionally provided between a cylindrical outer wall of the valve seat 51 and an inner wall of the valve chamber 47. The water in the valve chamber 47 is prevented from overflowing from the valve seat 51 by setting the sealing ring (f). A bolt 90 is inserted into the second positioning through hole 611 and is threadedly connected to the threaded hole 481 of the first positioning post 48. A bolthead 91 of the bolt 90 can interfere with the retaining edge 612 in the second positioning through hole 611 in the axial direction, thereby preventing the valve seat 51 and the knob 60 from being detached relative to the first positioning post 48 axially outwardly. Preferably, an adjustment gasket 80 is additionally provided between the bolthead 91 of the bolt 90 and the retaining edge 612. By using adjustment gaskets 80 of different thicknesses, an axial spacing between the retaining edge 612 of the second positioning through hole 611 and the bolthead 91 of the bolt 90 can be well adjusted, so that a clearance fit is created between an end of the adjustment gasket 80 and the retaining edge 612 to prevent the knob 60 from being displaced outwards in the axial direction of the seat body 40. A cylinder wall of the valve seat 51 is provided with a first position-limiting fitting portion 515 on a side of the cylinder wall facing towards the knob 60. The first position-limiting fitting portion 515 is several notches 515 provided at the end of the inner cylinder wall 517. The inner wall of the knob 60 is provided with a second position-limiting fitting portion 62 at a position corresponding to the first position-limiting fitting portion 515. The second position-limiting fitting portion 62 is position-limiting bars 62 provided on the inner wall of the knob 50. Through the mutual engagement between the notches 515 and the position-limiting bars 62, the knob 60 is enabled to rotate synchronously with the valve seat 51. The valve seat 51 forms an installation cavity 511 and a water collecting cavity 512 on the side of the valve seat 51 facing towards the water diverting piece (S). The installation cavity 511 and the water collecting cavity 512 are arranged in the circumferential direction of the valve seat 51. The plug 52 and the first spring 53 are arranged in the installation cavity 511 sequentially from the outside to the inside. The elastic restoring force of the first spring 53 drives the plug 52 to always fit against the water diverting piece (S). The knob 60 is arranged to move along with the valve seat 51. By rotating the knob 60, the valve seat 51 is driven to rotate circumferentially, so that the plug 52 on the valve seat 51 selectively blocks the first water inlet (S2) or the second water inlet (S3), or blocks both part of the first water inlet (S2) and part of the second water inlet (S3) simultaneously, so that the water flowing in through the water inlet port 41 sequentially flows through the water inlet passage 44 and the water outlet (S1) of the water diverting piece (S) into the water collecting cavity 512, and then flows through the first water inlet (S2) and/or the second water inlet (S3) of the water diverting piece (S) into the first water outlet passage 45 or the second water outlet passage 46 correspondingly, and finally flow out from the first water outlet port 42 and/or the second water outlet port 43. Since the seat body 40 is generally produced by an injection molding process, in order to facilitate the molding of the first positioning post 48 on the water diverting piece (S) of the valve chamber 47, as shown in FIG. 8, the seat body 40 and the water diverting piece (S) are designed to be separated, and the water diverting piece (S) is fixedly connected to the inner cavity of the seat body 40 through ultrasonic welding. The water flowing in through the water inlet port 41 passes through the water inlet passage 44 and the water outlet (S1) of the water diverting piece (S) in sequence and is accumulated in the water collecting cavity 512. An inner cavity wall of the first positioning through hole 514 of the valve seat 51 is provided with an arc-shaped notch 513, and the water diverting piece (S) of the seat body 40 is provided with a position-limiting block 49 at a position corresponding to the arc-shaped notch 513. The fitting between the position-limiting block 49 and the arc-shaped notch 513 limits the rotation range of the valve seat 51 in the valve chamber 47. A positioning sound mechanism 100 is further provided between the cylinder wall of the valve seat 51 and the inner wall of the valve chamber 47. The positioning sound mechanism 100 includes a stopper 102, a second spring 103, a counter bore 101 extending from the outer cylinder wall 516 of the valve seat 51 to the inner cylinder wall 517, and positioning depressions 104 provided in the inner wall of the valve chamber 47. The second spring 103 and the stopper 102 are arranged in the counter bore 101 sequentially from the inside to the outside. When the valve seat 51 is rotated relative to the seat body 40, the stopper 102 switches between the positioning depressions 104 in the valve chamber 47 and generates sound.

It is to be noted that the waterway switching device 5 is not limited to the above-mentioned embodiment, a waterway switching mechanism similar to that disclosed in U.S. Pat. No. 7,299,510 may also be used in the valve chamber 47, or a press type waterway switching mechanism similar to the ballpoint pen button such as that in U.S. Pat. No. 8,474,482 B2 may be used in the valve chamber 47. In short, the person of ordinary skill in the art has the motivation to make necessary adjustment on the positions of the water holes via which water flows between the water inlet passage 44, the first water outlet passage 45, the second water outlet passage 46 and the valve chamber, to meet the configuration requirements of different types of waterway switching mechanisms mentioned above.

Figure 3:
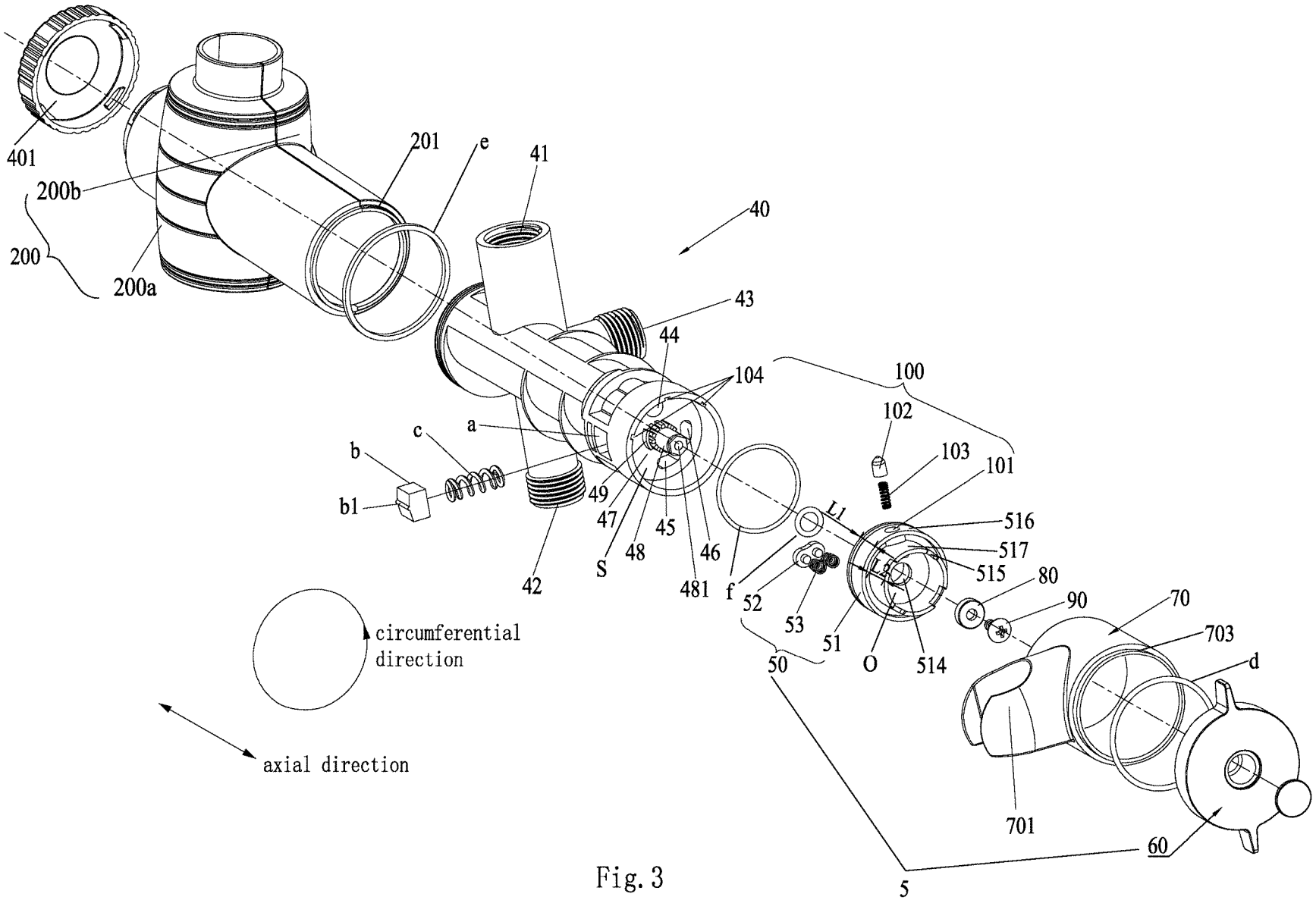
FIG. 3 and FIG. 4 are three-dimensional exploded views from two angles of the holder device according to the present application.
Figure 4:
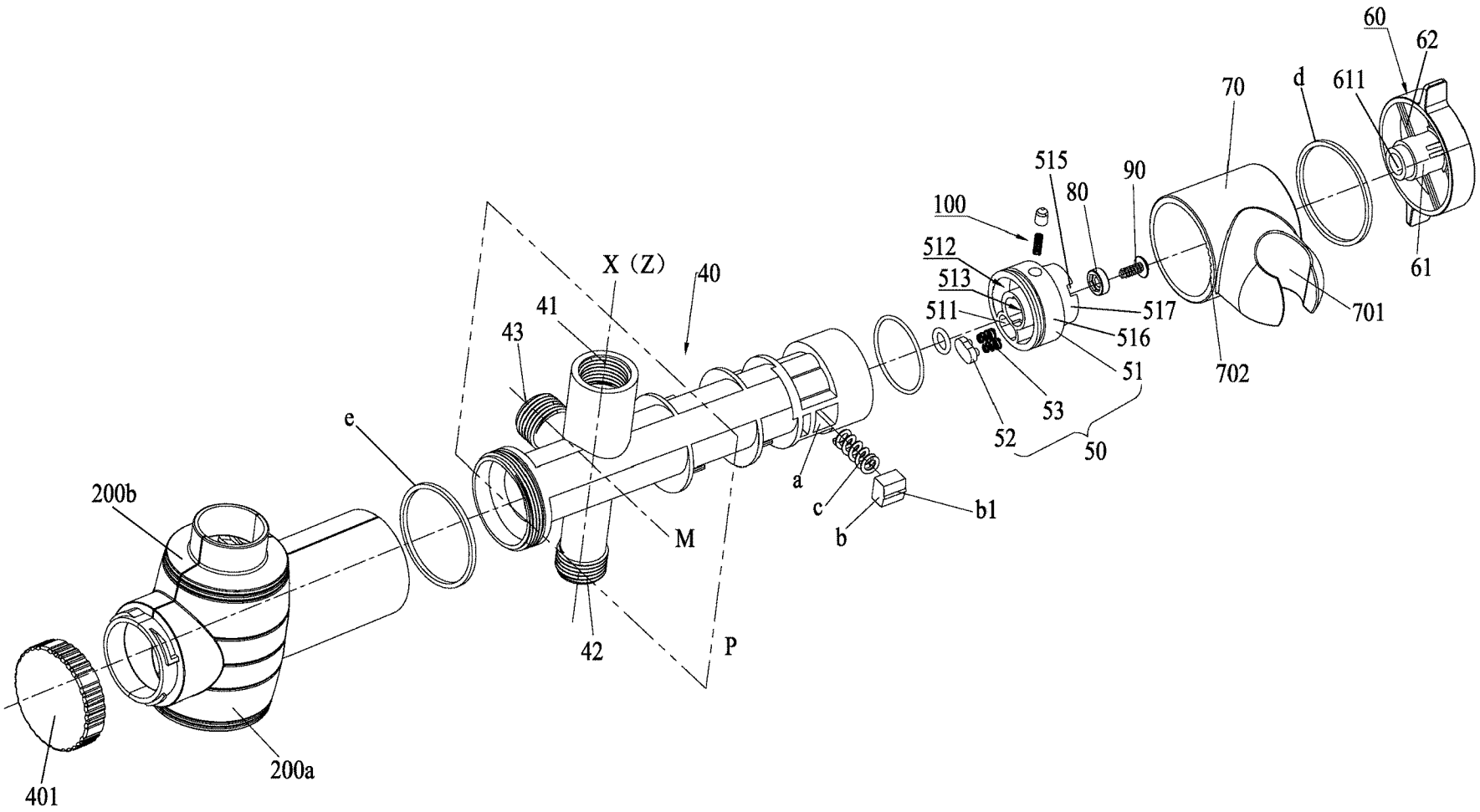

As shown in FIG. 3, the attaching seat 70 is sleeved on the seat body 40 and is adjacently connected to the knob 60, so that the attaching seat 70 and the knob 60 are jointly arranged offset with respect to the first water outlet port 42 in the axial direction of the seat body 40. The attaching seat 70 is provided with a socket 701, and the socket 701 is configured to hang the handheld water outlet device 700. The attaching seat 70 is in a cylindrical shape with a hollow inner cavity. The seat body 40 is constructed as a rotary body at least in the region corresponding to the attaching seat 70. The attaching seat 70 can be sleeved on the rotary body and is rotatable with respect to the rotary body. The rotary body is further provided with a mounting slot (a), and a positioning block (b) and a third spring c are arranged in the mounting slot (a) sequentially from the outside to the inside. A convex rib (b1) is provided on an outer end surface of the positioning block (b), and an inner wall of the attaching seat 70 is provided with multiple positioning grooves 702 at the position corresponding to the convex rib (b1). Through the fitting of the convex rib (b1) with the positioning grooves 702, the attaching seat 70 can be attached on the seat body 40 in an angle-adjustable manner.

Figure 2:
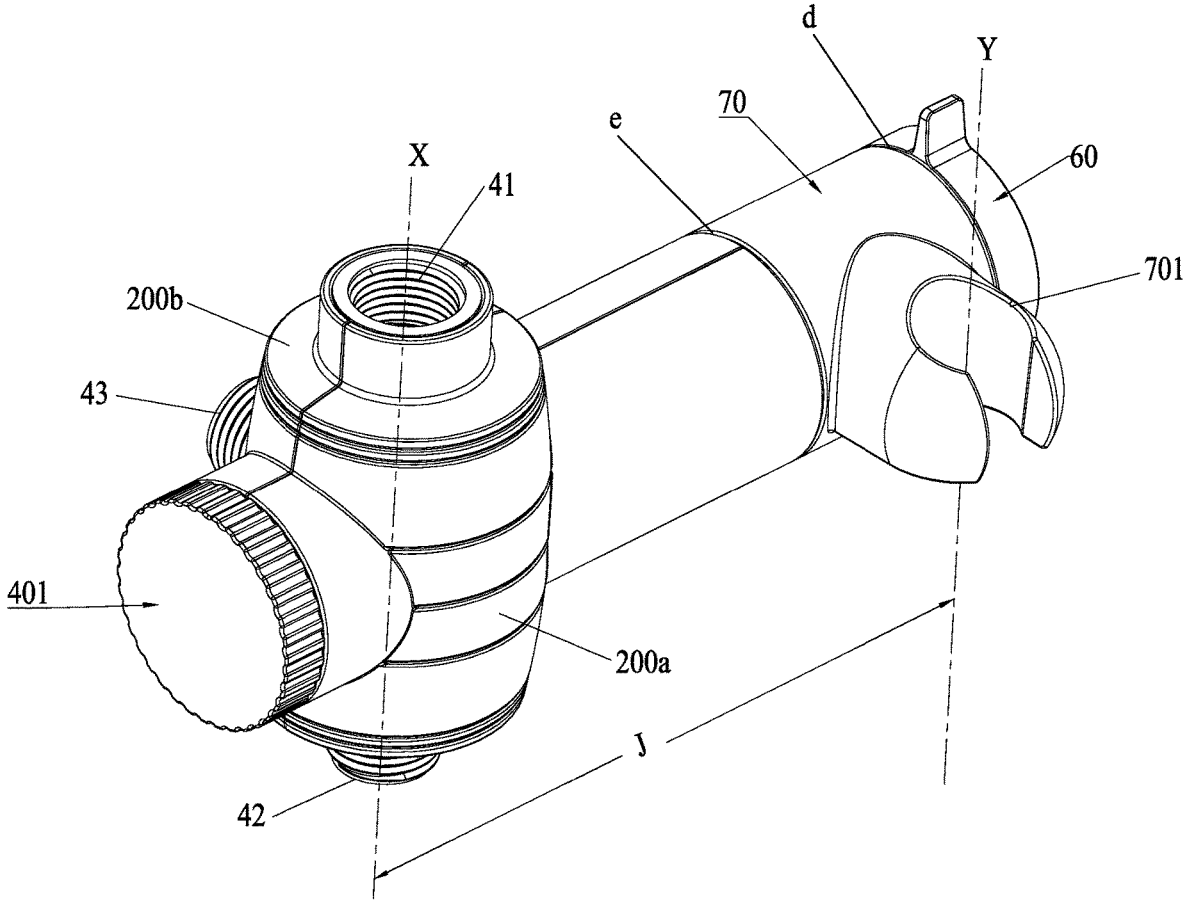
FIG. 2 is a three-dimensional assembly view of a holder device according to the present application.

In a more preferred design, as shown in FIG. 2, an axial spacing J between the central axis X of the first water outlet port 42 and a central axis Y of the socket 701 of the attaching seat 70 is in the range of 40 mm to 200 mm. With such a design, when 40 mm is selected for J, the first water outlet port 42 can be connected to an overhead shower 600 with a diameter below 4 inches (including 4 inches), and the user can easily pick and place it; and when 200 mm is selected for J, the first water outlet port 42 can be connected to an overhead shower 600 with a diameter below 14 inches (including 14 inches), and the user can easily pick and place it. In short, the magnitude of the value of the axial spacing J between the central axis X of the first water outlet port 42 and the central axis Y of the socket 701 of the attaching seat 70 can be positively correlated with the range of size of the overhead shower 600. When the value of the spacing J is large, the range of size of the overhead shower 600 adaptable is large.

Figure 13:
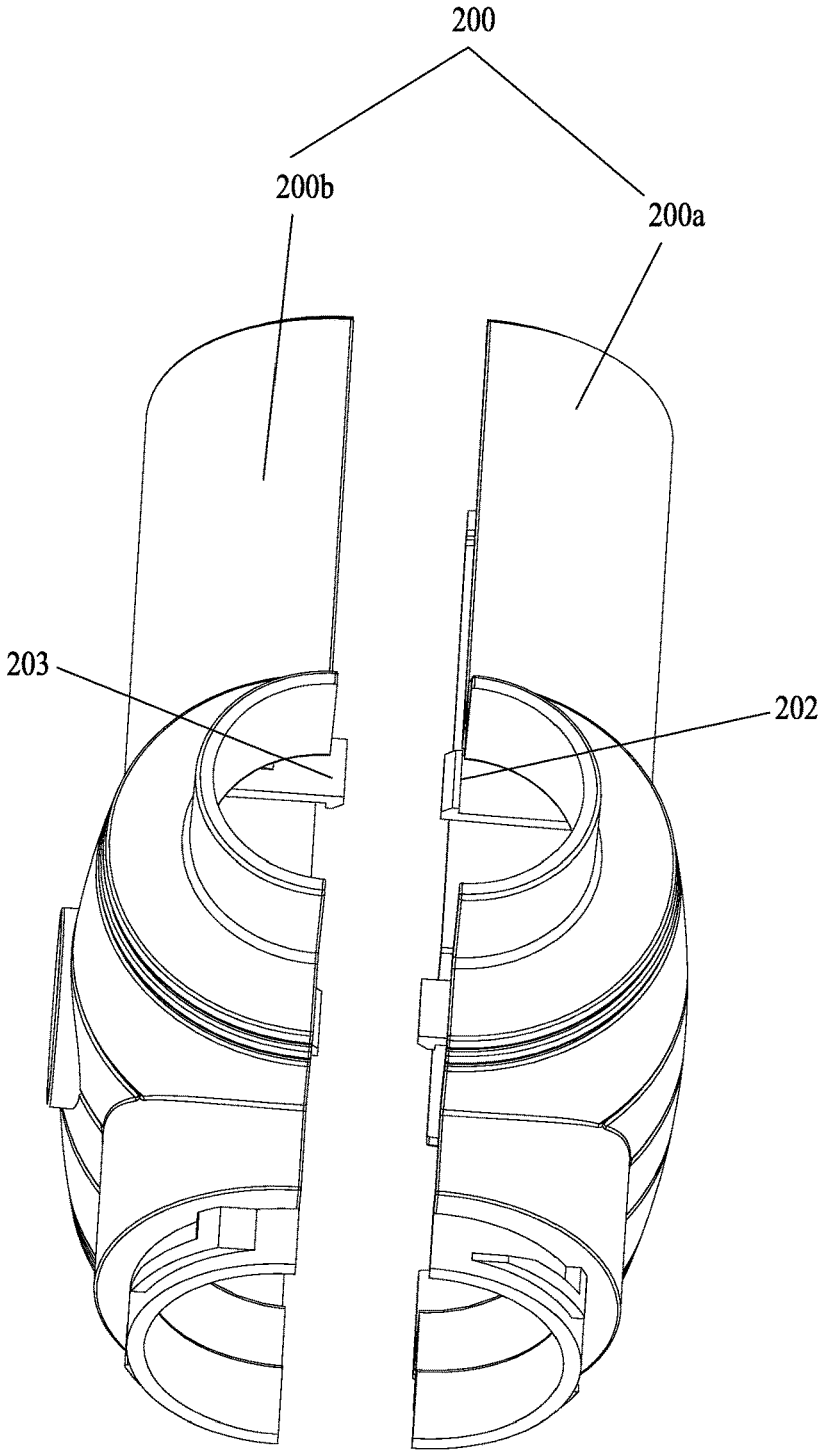
FIG. 13 is an exploded perspective view of a front shell and a rear shell according to the present application.
Figure 14:
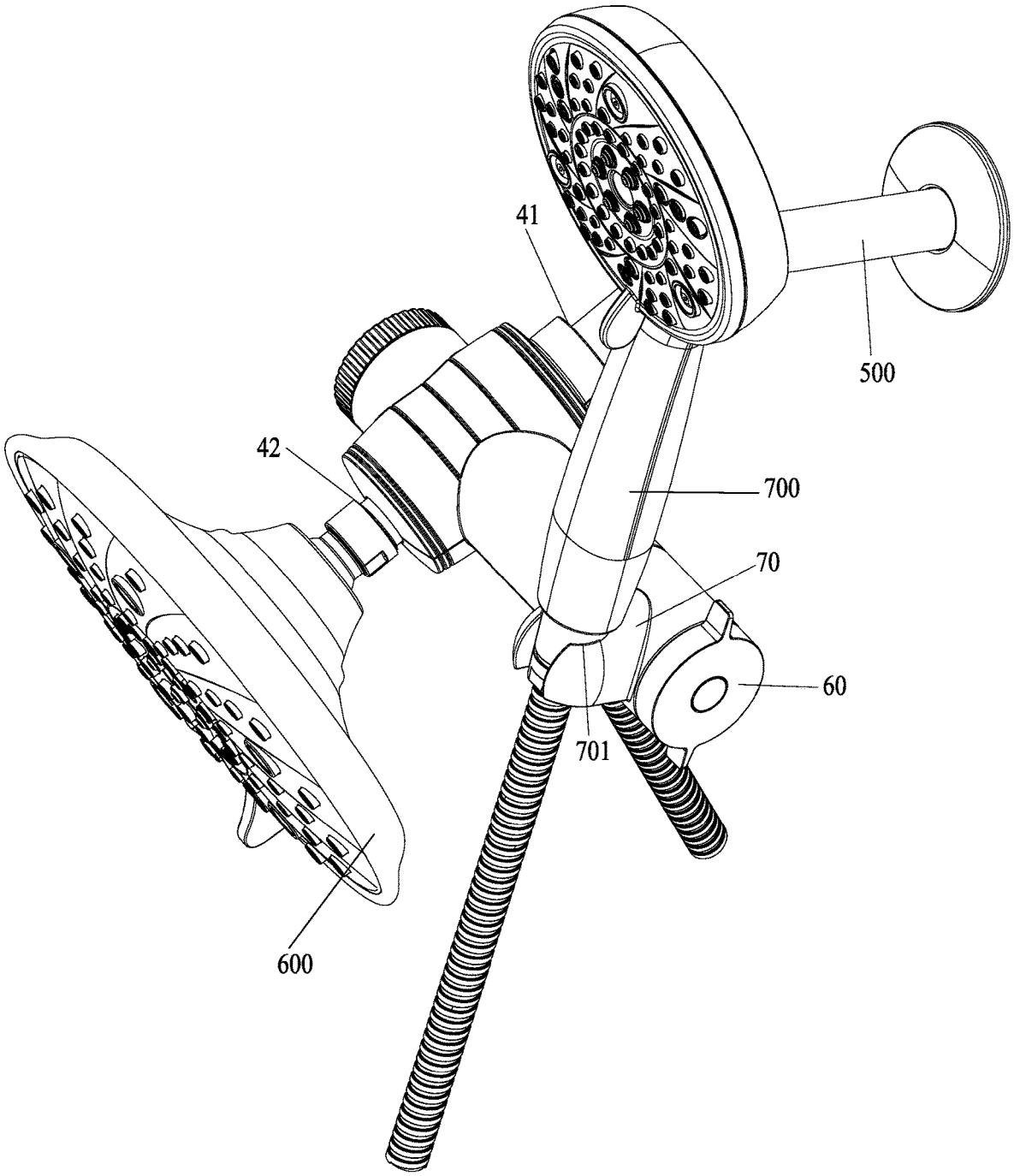
FIG. 14 is a schematic diagram of the use state of the holder device according to the present application.

Reference is made to FIGS. 2 and 13, the holder device further includes a front shell 200*a* and a rear shell 200*b*. An inner cavity wall of the front shell 200*a* is provided with at least one first locking portion 202, and an inner cavity wall of the rear shell 200*b* is provided with a second locking portion 203 at a position corresponding to the first locking portion 202. The first locking portion 202 and the second locking portion 203 are locked with each other, so that the front shell 200*a* and the rear shell 200*b* are assembled into an outer shell 200 with a hollow inner cavity. The outer shell 200 covers inside a region of the seat body 40 where the attaching seat 70 is not arranged.

In a more preferred design, as shown in FIGS. 3 and 5, a first wear-resistant gasket (d) is placed between the attaching seat 70 and the knob 60, and a second wear-resistant gasket (c) is placed between the outer shell 200 and the attaching seat 70. The arrangement of the first wear-resistant gasket (d) and the second wear-resistant gasket (e) can prevent the attaching seat 70 and the knob 60 from generating noise when they rotate, and moreover, an end face of the outer shell 200 facing towards the attaching seat 70 forms a second annular step surface 201, and the second wear-resistant gasket (e) is sleeved on the second annular step surface 201, therefore, the second wear-resistant gasket (e) may also constrict the front shell 200*a* and the rear shell 200*b* to each other to form a stable connection between the front shell 200*a* and the rear shell 200*b*.

The specific working principle of the present application is as follows.

When an external force rotates the knob 60 to drive the plug 52 to block the first water inlet (S2) in the water diverting piece (S), an external water source flows sequentially through the water inlet port 41 and the water inlet passage 44 into the water collecting cavity 512 of the valve seat 51, then flows via the second water inlet (S3) in the water diverting piece (S) into the second water outlet passage 46 and flows out from the second water outlet port 43, and finally, the water flow is sprayed outward from the handheld water outlet device 700. When the knob 60 is rotated to drive the plug 52 to block the second water inlet (S3) in the water diverting piece (S), an external water source flows sequentially through the water inlet port 41 and the water inlet passage 44 into the water collecting cavity 512 of the valve seat 51, then flows via the first water inlet (S2) in the water diverting piece (S) into the first water outlet passage 45 and flows out from the first water outlet port 42, and finally, the water flow is sprayed outward from the overhead shower 600. When the knob 60 is rotated to drive the plug 52 to block both part of the first water inlet (S2) and part of the second water inlet (S3) in the water diverting piece (S) simultaneously, an external water source flows sequentially through the water inlet port 41 and the water inlet passage 44 into the water collecting cavity 512 of the valve seat 51, then flows via the first water inlet (S2) and the second water inlet (S3) in the water diverting piece (S) correspondingly into the first water outlet passage 45 and the second water outlet passage 46 and flows out from the first water outlet port 42 and the second water outlet port 43, and finally, the water flow is sprayed outward from both the overhead shower 600 and the handheld water outlet device 700 simultaneously.

The beneficial effect of the present application is that by jointly setting the attaching seat 70 and the knob 60 to be offset with respect to the first water outlet port 42 in the axial direction of the seat body 40, the attaching seat 70 and the knob 60 will not be blocked by a large-sized overhead shower 600, thereby making it easy to pick and place the handheld water outlet device 700, and also facilitating water passage switching.

Figure 11:
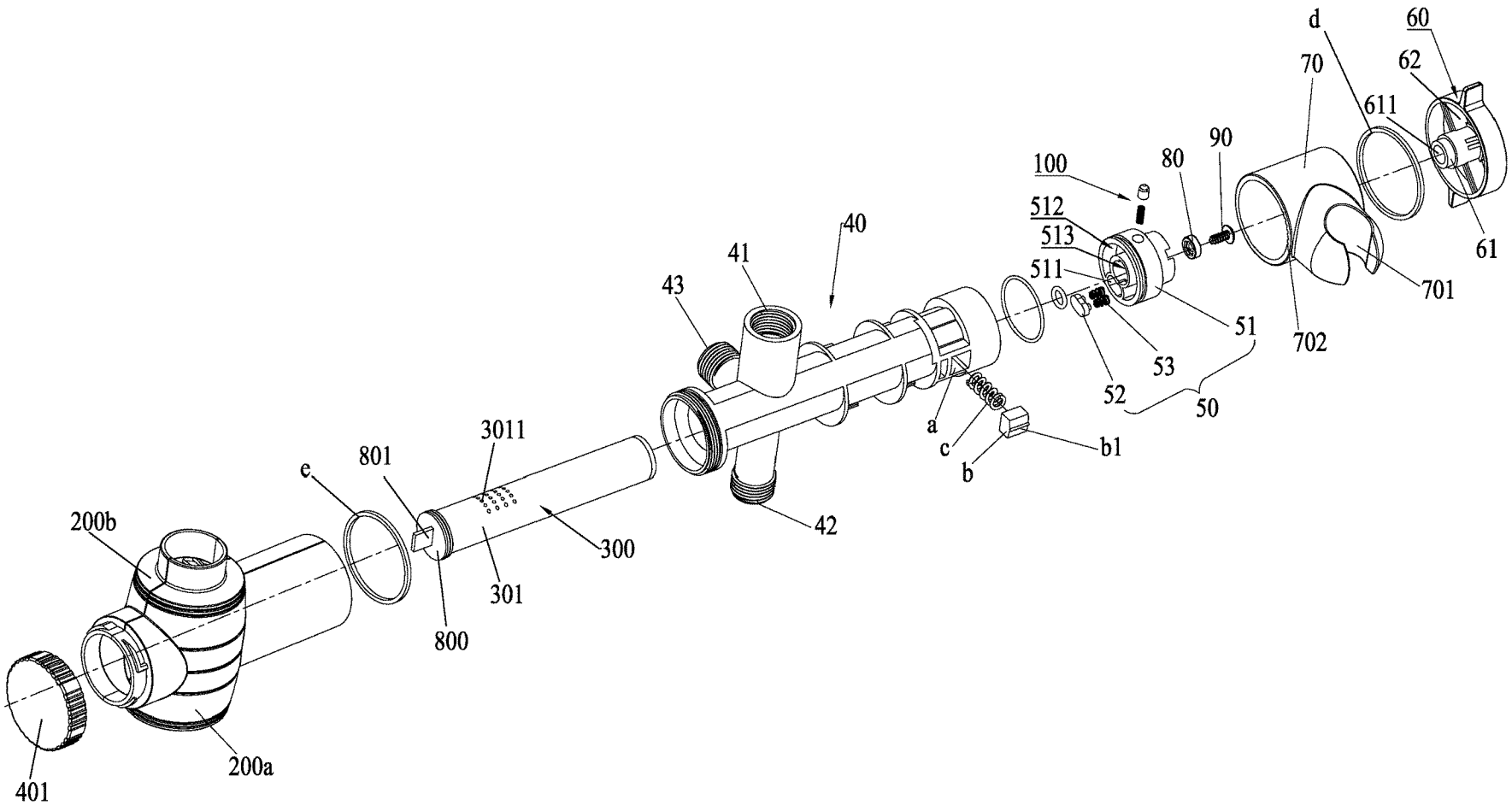
FIG. 11 is an exploded view of the holder device according to the present application including a filter element.
Figure 12:
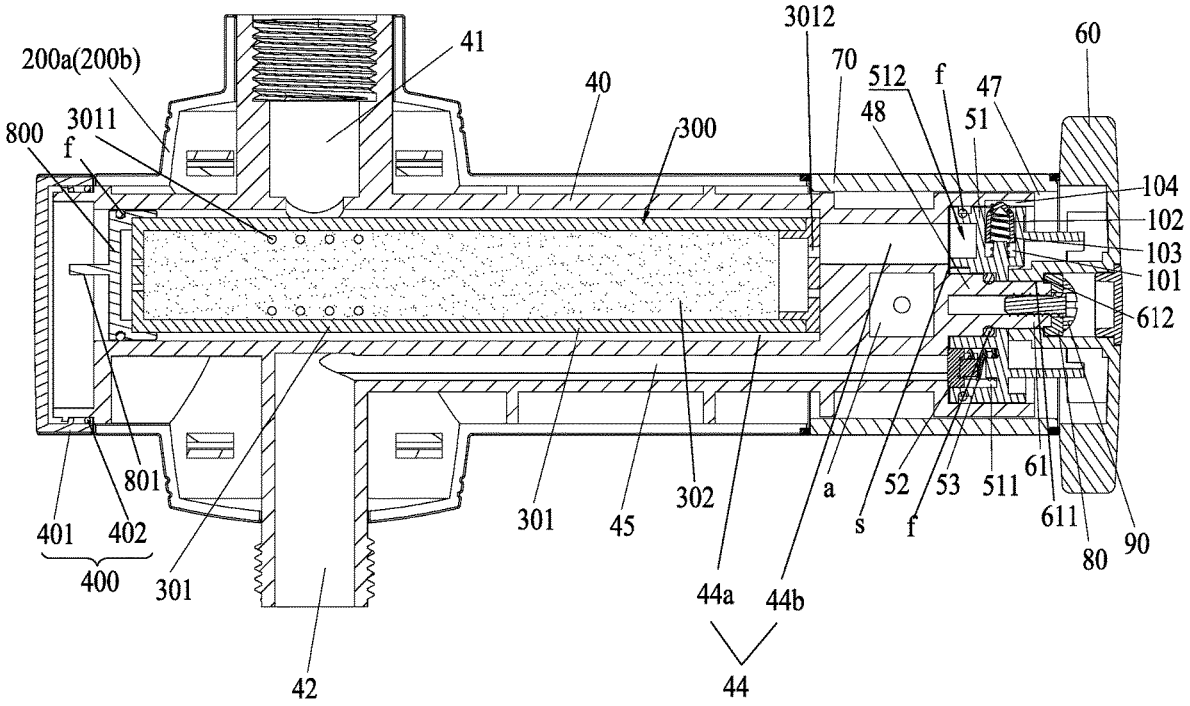
FIG. 12 is a longitudinal cross-sectional view of the holder device according to the present application including the filter element.

Please refer to FIGS. 11 and 12. A holder device for a shower apparatus is further disclosed in the present application, in which, the water inlet passage 44 is arranged in the axial direction of the seat body 40 and has a large diameter segment 44*a* and a small diameter segment 44*b*. The holder device further includes a filter element 300. The filter element 300 includes a body 301 and a filter material 302 built into the body 301. The body 301 is provided with an inlet end 3011 and an outlet end 3012. The filter material can be selected from activated carbon, Calcium sulfite balls, KDF, antibacterial balls, VC mineralized balls, etc. and it is possible to select only one from the above filter materials or select multiple materials and mix the selected materials for the filter material. The filter element 300 is placed in the large diameter segment 44*a* of the water inlet passage 44, its inlet end 3011 is in fluid connection with the water inlet port 41, and its outlet end 3012 is in fluid connection with the outlet end of the water inlet passage 44. The water flowing in through the water inlet port 41 passes through sequentially the inlet end 3011 and the outlet end 3012 of the filter element 300, the water inlet passage 44 and the water outlet (S1) of the water diverting piece (S) and flows into the water collecting cavity 512 of the valve seat 51, and selectively flows into the first water outlet passage 45 and/or the second water outlet passage 46, thereby realizing that the water flow flows out from the first water outlet port 42 and/or the second water outlet port 43. By additionally providing the filter element 300, water filtration is achieved, thereby improving the quality of life.

In a more preferred design, a supporting cover 800 is additionally provided to the side of the filter element 300 adjacent to the closed end 400 of the seat body 40. The supporting cover 800 and the filter element 300 are tightly matched, and a sealing ring (f) is additionally provided between the supporting cover 800 and an inner wall of the large diameter segment 44*a* of the water inlet passage, to prevent water in the water inlet passage 44 from outflowing to the cover 401. The supporting cover 800 is provided with a handle 801. When to replace the filter element 300, the cover 401 is removed first, then the handle 801 is held and pulled outwards, thus the supporting cover 800 together with the filter element 300 can be taken out, thereby quickly and conveniently replacing the filter element 300.

The above description merely relates to embodiments of the present disclosure, and is not intended to limit the design of the present disclosure. Any equivalent changes made according to key points of the design of the present disclosure will fall within the scope of protection of the present disclosure.

The invention claimed is:

1. A holder device for a shower apparatus, comprising a seat body, a waterway switching device, a filter element and an attaching seat, the seat body is configured to extend in an axial direction thereof, one end of the seat body forms a closed end, and a waterway switching device is disposed at another end of the seat body, an outer wall of the seat body is provided with a water inlet port, a first water outlet port and a second water outlet port, the first water outlet port is arranged on a side adjacent to the closed end, the water inlet port is configured to be connected to a water outlet tube, the first water outlet port is configured to be connected to an overhead shower, and the second water outlet port is configured to be connected to a water outlet hose of a handheld water outlet device; an inner cavity of the seat body is provided with a water inlet passage, a first water outlet passage and a second water outlet passage arranged in parallel with each other at intervals in the axial direction of the seat body; a water diverting piece is provided in the inner cavity of the seat body at a side adjacent to the waterway switching device of the water inlet passage, the first water outlet passage and the second water outlet passage, the water diverting piece is provided with a water outlet, a first water inlet and a second water inlet, and by the water diverting piece, the inner cavity of the seat body is constructed as a valve chamber at the end on the side where the water diverting piece is located; one end of the water inlet passage is in fluid connection with the water inlet port, and another end of the water inlet passage is in fluid connection with the water outlet of the water diverting piece; one end of the first water outlet passage is in fluid connection with the first water outlet port, and another end of the first water outlet passage is in fluid connection with the first water inlet of the water diverting piece, and one end of the second water outlet passage is in fluid connection with the second water outlet port, and another end of the second water outlet passage is in fluid connection with the second water inlet of the water diverting piece;

the filter element comprises a body and a filter material built into the body, the body is provided with an inlet end and an outlet end, the filter element is placed in the water inlet passage, water flowing in through the water inlet port passes through sequentially the inlet end and the outlet end of the filter element, the water outlet of the water diverting piece and flows into the valve chamber;

the waterway switching device comprises an actuator and a water diverting valve core, the actuator is arranged at an end of the seat body, the water diverting valve core is arranged in the valve chamber, and is at least provided with a plug facing towards the water diverting piece, an external force acts on the actuator to drive the plug of the water diverting valve core to be displaced, to allow the plug to selectively block the first water inlet or the second water inlet of the water diverting piece, or block both part of the first water inlet and part of the second water inlet in the water diverting piece simultaneously, to control water to flow out from the first water outlet port and/or the second water outlet port; and the attaching seat is sleeved on the seat body and is adjacently connected to the actuator, to allow the attaching seat and the actuator to be jointly arranged offset with respect to the first water outlet port in the axial direction of the seat body, the attaching seat is provided with a socket, and the socket is configured to hang the handheld water outlet device.

2. The holder device according to claim 1, wherein an axial spacing J between a central axis X of the first water outlet port and a central axis Y of the socket of the attaching seat is in the range of 40 mm to 200 mm.

3. The holder device according to claim 1, wherein the water inlet port is arranged opposite to the first water outlet port, and a central axis Z of the water inlet port, a central axis X of the first water outlet port and a central axis M of the second water outlet port are located in the same plane P.

4. The holder device according to claim 1, wherein the actuator is a knob; and the water diverting valve core comprises a valve seat, the plug and a first spring, the valve seat is in a cylindrical shape, the valve seat forms an installation cavity and a water collecting cavity on a side facing towards the water diverting piece, the water collecting cavity is in fluid connection with the water inlet passage, the plug and the first spring are arranged in the installation cavity sequentially from the outside to the inside, an elastic restoring force of the first spring drives the plug to always fit against the water diverting piece, the knob is arranged to move along with the valve seat, by rotating the knob, the valve seat is driven to rotate circumferentially, and the plug on the valve seat selectively blocks the first water inlet or the second water inlet of the water diverting piece, or blocks both part of the first water inlet and part of the second water inlet simultaneously, to control the water flow to flow out from the first water outlet port and/or the second water outlet port.

5. The holder device according to claim 4, wherein a first positioning post is provided to protrude from the center of the water diverting piece, the first positioning post is provided therein with a threaded hole, the valve seat is provided with a first positioning through hole at a central axial part of the valve seat, a cylinder wall of the valve seat is provided with a first position-limiting fitting portion on a side of the cylinder wall facing towards the knob, an inner wall of the knob is provided with a second positioning post at a central axial part of the inner wall, the second positioning post is provided with an axially penetrating second positioning through hole, the second positioning through hole is provided therein with a retaining edge, the inner wall of the knob is provided with a second position-limiting fitting portion at a position corresponding to the first position-limiting fitting portion, the first positioning through hole of the valve seat and the second positioning post of the knob are sleeved on the first positioning post in sequence from the inside to the outside, to allow an end of the second positioning post to abut against an outer edge end of the first positioning through hole, also through a mutual engagement between the first position-limiting fitting portion and the position-limiting portion, the knob is enabled to rotate synchronously with the valve seat; and a bolt is inserted into the second positioning through hole and is threadedly connected to the threaded hole of the first positioning post, and a bolthead of the bolt interferes with the retaining edge in the second positioning through hole in the axial direction, to prevent the valve seat and the knob from being detached relative to the first positioning post outwardly in the axial direction.

6. The holder device according to claim 5, wherein an adjustment gasket is additionally provided between the bolthead and the retaining edge.

7. The holder device according to claim 5, wherein an inner cavity wall of the first positioning through hole of the valve seat is provided with an arc-shaped notch, and the water diverting piece of the seat body is provided with a position-limiting block at a position corresponding to the arc-shaped notch, and a fitting between the position-limiting block and the arc-shaped notch limits the rotation range of the valve seat in the valve chamber.

8. The holder device according to claim 4, wherein a positioning sound mechanism is further provided between a cylinder wall of the valve seat and an inner wall of the valve chamber, the positioning sound mechanism comprises a stopper, a second spring, a counter bore arranged in the cylinder wall of the valve seat, and positioning depressions provided in the inner wall of the valve chamber, the second spring and the stopper are arranged in the counter bore sequentially from the inside to the outside, and when the valve seat is rotated relative to the seat body, the stopper switches between the positioning depressions in the valve chamber and generates sound.

9. The holder device according to claim 8, wherein the valve seat has an outer cylinder wall and an inner cylinder wall which are concentrically arranged, and an axial length L1 of the outer cylinder wall is smaller than an axial length L2 of the inner cylinder wall, the counter bore is configured to extend from the outer cylinder wall to the inner cylinder wall, the inner cylinder wall is provided with a plurality of notches at an end of the inner cylinder wall, the notches are the first position-limiting fitting portion, the knob is provided with position-limiting bars at positions corresponding to the notches, and the position-limiting bars are the second position-limiting fitting portion.

10. The holder device according to claim 1, wherein the attaching seat is in a cylindrical shape with a hollow inner cavity, the seat body is constructed as a rotary body at least in a region corresponding to the attaching seat, the attaching seat is arranged to be sleeved on the rotary body and is rotatable with respect to the rotary body, the rotary body is further provided with a mounting slot, and a positioning block and a third spring are arranged in the mounting slot sequentially from the outside to the inside, a convex rib is provided on an outer end surface of the positioning block, and an inner wall of the attaching seat is provided with a plurality of positioning grooves at a position corresponding to the convex rib, and through a fitting of the convex rib with the positioning grooves, the attaching seat is attached on the seat body in an angle-adjustable manner.

11. The holder device according to claim 1, further comprising a front shell and a rear shell, wherein the front shell and the rear shell are assembled to each other, to cover a region of the seat body where the attaching seat is not arranged.

12. The holder device according to claim 1, wherein the water inlet passage is arranged in the axial direction of the seat body and has a large diameter segment and a small diameter segment, the filter element is placed in the large diameter segment, and the closed end of the seat body is formed by a detachable cover and a sealing member.

13. The holder device according to claim 12, wherein a supporting cover is additionally provided to a side of the filter element adjacent to the closed end of the seat body, the supporting cover and the filter element are tightly matched, and a sealing ring is additionally provided between the supporting cover and an inner wall of the large diameter segment of the water inlet passage, and the supporting cover is provided with a handle.

* * * * *